United States Patent [19]

Bendig et al.

[11] Patent Number: 4,989,788

[45] Date of Patent: Feb. 5, 1991

[54] BINARY FLAT-JET NOZZLE FOR ATOMIZING LIQUIDS

[75] Inventors: Lothar Bendig, Pfullingen; Karl Holder, Urach-Hengen, both of Fed. Rep. of Germany

[73] Assignee: Lechler GmbH & Co. KG, Fellbach, Fed. Rep. of Germany

[21] Appl. No.: 466,596

[22] Filed: Jan. 17, 1990

[30] Foreign Application Priority Data

May 10, 1989 [DE] Fed. Rep. of Germany ..... 3915210

[51] Int. Cl.[5] ..... B05B 7/04

[52] U.S. Cl. ..... 239/429; 239/432; 239/433; 239/590.3; 239/597

[58] Field of Search ..... 239/429, 432, 433, 434, 239/590.3, 597

*Primary Examiner*—Andres Kashnikow
*Assistant Examiner*—Lesley Morris
*Attorney, Agent, or Firm*—Shlesinger & Myers

[57] ABSTRACT

A binary atomizing flat-jet nozzle with rectangle characteristic comprises a mixing head forming a mixing chamber with two mutually orthogonal connectors for a gaseous and a liquid medium, further a preferably tubular connector connecting to those connectors and a snout forming the slitted nozzle discharge. A metering inset with a cylindrical blind bore is mounted in the second connector supplying the liquid, the blind bore issuing inside the mixing chamber bilaterally into cross-bores. The snout comprises an offset bore with arched bottom. A baffle with a sharp-edged central transmission aperture rests on the bore offset and comprises an inside diameter less than the diameter of the offset snout bore. A nozzle with the above features is characterized by its simple design, easy manufacture and very uniform liquid distribution (so-called rectangle characteristic).

10 Claims, 3 Drawing Sheets

BINARY FLAT-JET NOZZLE FOR ATOMIZING LIQUIDS

Figure 1:
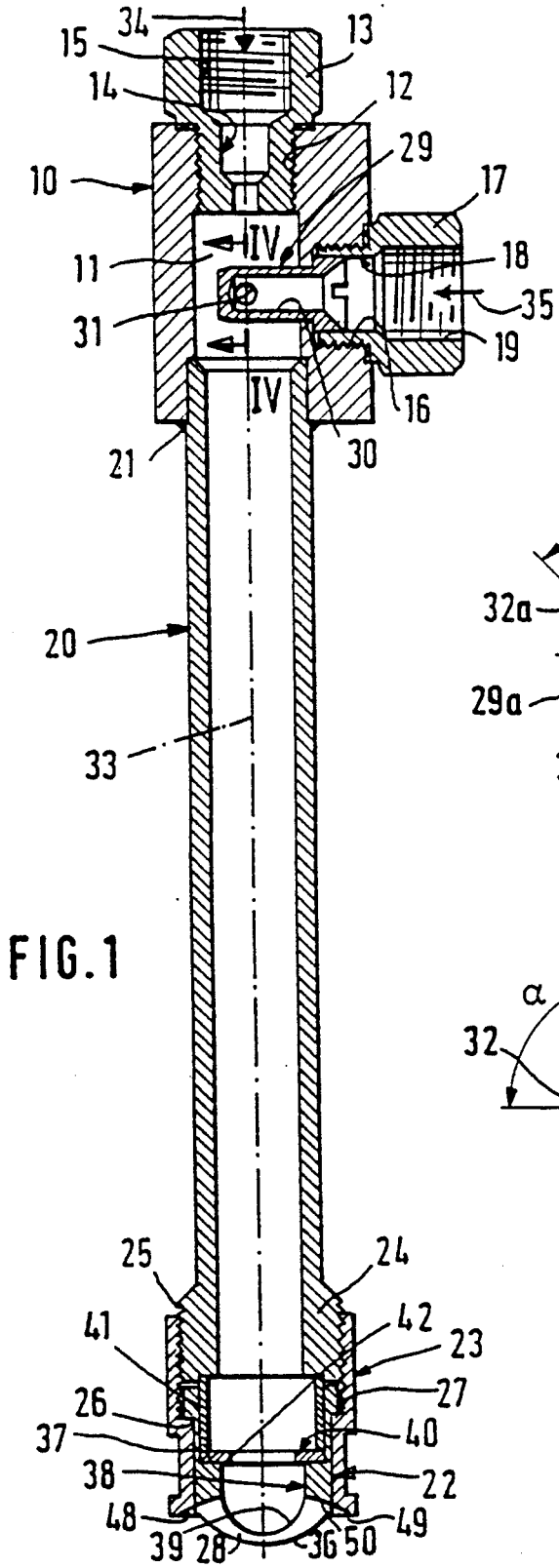

The invention concerns a binary flat-jet nozzle defined in the preamble of claim 1.

Such flat-jet nozzles for atomizing liquids as a rule operate in the pressure range of 1 through 6 bars, both as regards the gas and the liquid pressures. Uniform liquid distribution (with so-called rectangle features being achieved as closely as possible) with the finest possible droplet spectrum should thereby be obtained. Those nozzles are used wherever the liquids must be deposited in the finest possible manner, also when cooling rolled products (continuous casting cooling), cooling gases and more.

A nozzle of the initially cited kind has been disclosed in the document WO 85/02132. This known nozzle incurs the drawback of a complex shape of the nozzle snout which can be manufactured only with substantial difficulty. Moreover the snout of the known nozzle is characterized by an externally mounted impact dish entailing another borehole with thread, a sealing surface and a seal.

In the light of this state of the art, it is the object of the present invention to create a binary flat-jet nozzle which on one hand can be manufactured in simple manner by cutting and on the other shall allow even more uniform liquid distribution than the known nozzle and an extremely fine drop spectrum.

This problem is solved by the invention for a binary flat-jet nozzle of the initially cited kind by the features listed in the characterizing part of claim 1.

Advantageous further developments and embodiment modes of the invention are stated in claims 2 through 10.

The invention is elucidated below by means of embodiments illustratively shown in the drawings and described in comprehensive detail.

Figure 5:
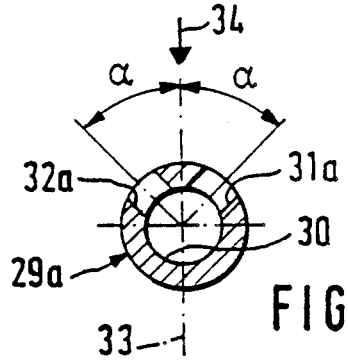
Figure 4:
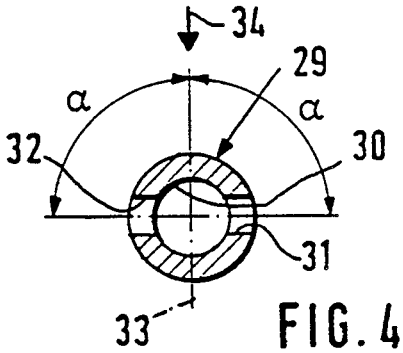
Figure 2:
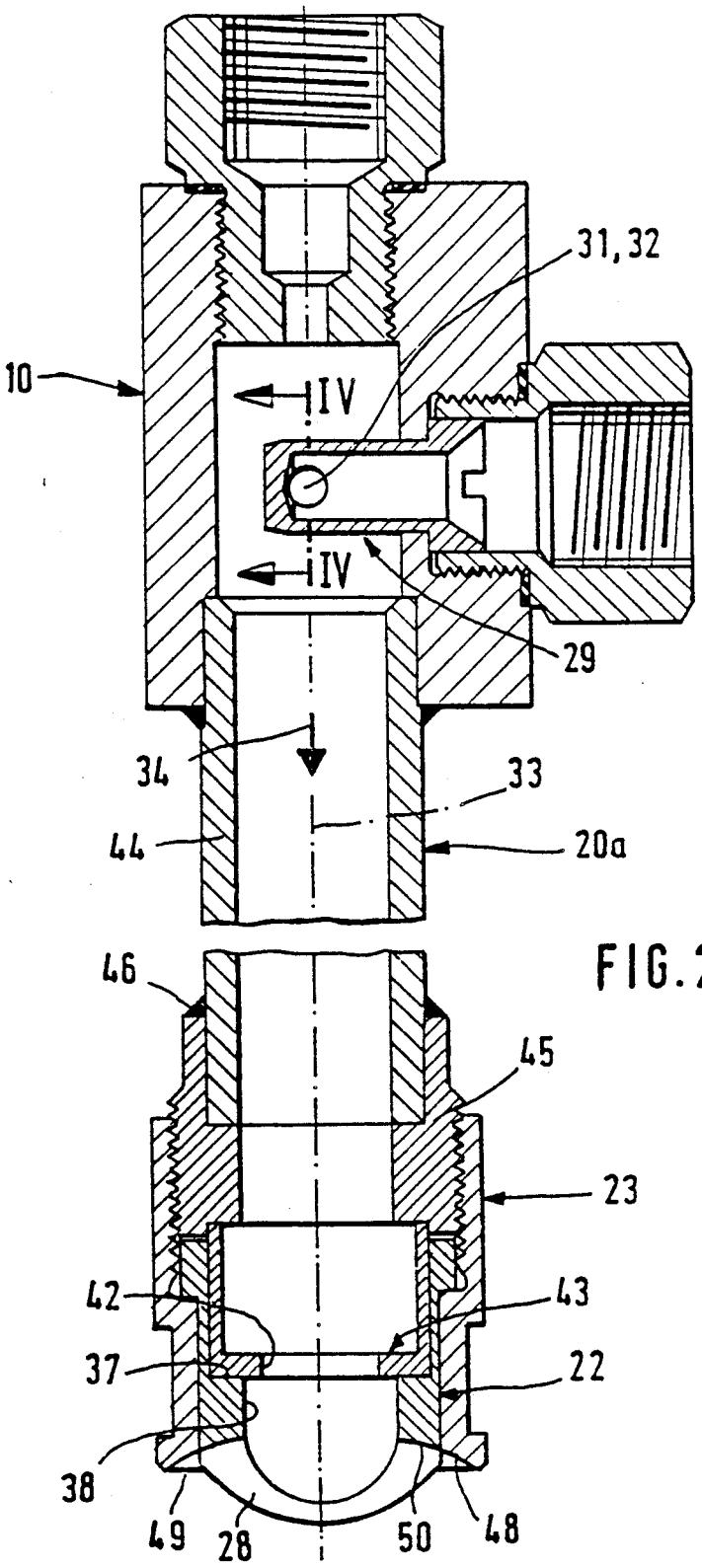
Figure 6:
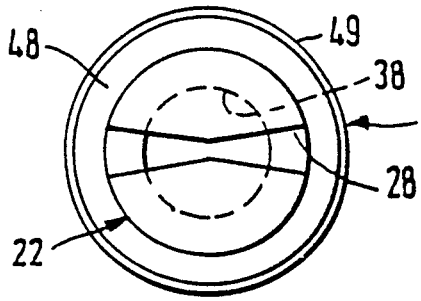
Figure 3:
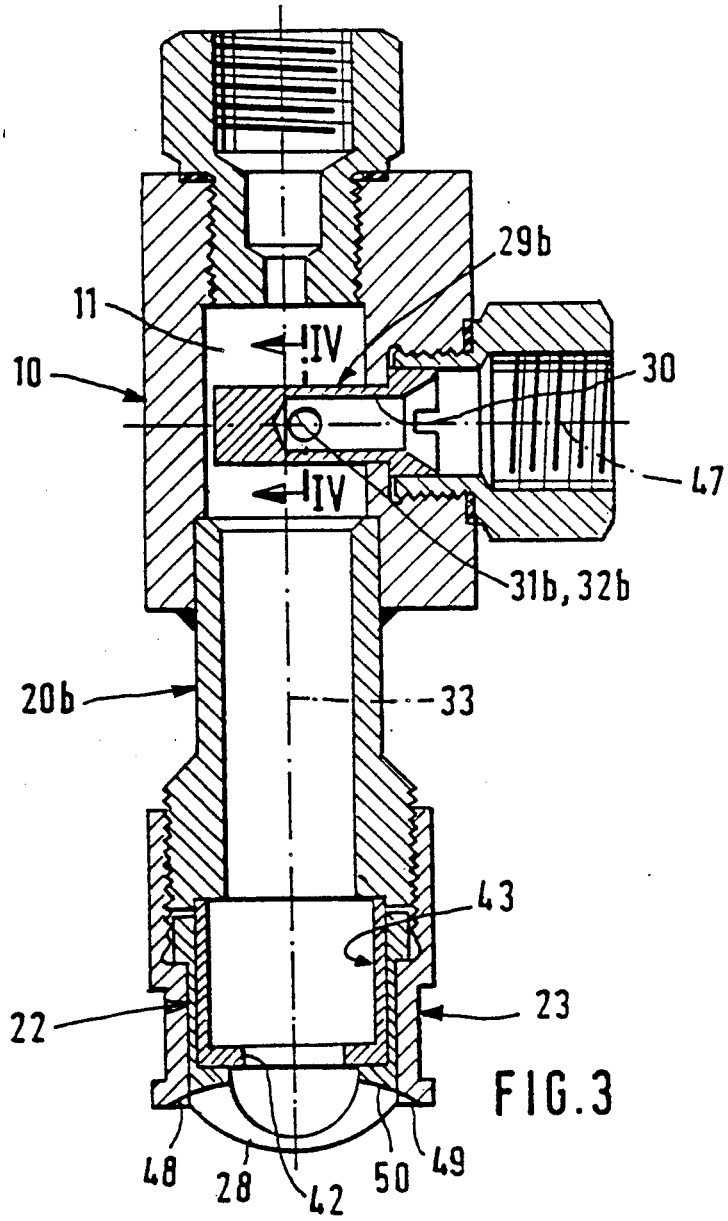

FIG. 1 is an embodiment mode of a binary flat-jet nozzle to atomize liquids, shown in vertical longitudinal section, FIGS. 2 and 3 are further embodiment modes of a binary flat-jet nozzle shown in the manner of FIG. 1, FIG. 4 is a section along line IV–IV of FIGS. 1, 2 and 3, FIG. 5 is another embodiment mode shown in the manner of FIG. 4, and FIG. 6 is the object of FIGS. 1, 2 or 3 seen in top-view.

The reference 10 denotes a mixing head with an inside mixing chamber 11. The mixing head is appropriately provided with a coaxial thread 12 into which is screwed a first connector 13. The first connector 13 supplies a gaseous medium such as air to the mixing chamber 11. For that purpose it is provided with a reduced bore 14 which comprises a thread 15 at its upper part into which can be screwed the (omitted) air supply conduit.

The mixing head 10 further comprises an offset threaded bore 16 at right angle to the threaded bore 12. A second connector 17 is screwed into the threaded bore 16 and accordingly is perpendicular to the first connector 13; it supplies a liquid medium, for instance water, to the mixing chamber 11. This second connector 17 also comprises a reduced bore 18 flaring at its intake where it is fitted with a thread 19. A suitable (omitted) liquid-supply conduit may be screwed into the thread 19.

A connecting tube 20 is hooked up to the first connector 13 at the side of the mixing head 10 opposite it and coaxially with the mixing chamber 11. The connecting tube 20 enters the mixing head 10 from below and is welded to it at 21. A snout 22 is detachably fastened by a coupling nut 23 to the lower end of the connecting tube 20. For that purpose, the connecting tube 20 comprises an expansion 24 with outer thread 25. The cylindrical snout 22 is offset at 26 where it cooperates with a matching offset 27 of the coupling nut 23. The nozzle discharge is in the form of a width-variable slit 28 milled or eroded into the snout 22.

FIGS. 1, 2 and 3 further show that a metering inset 29 is mounted in the reduced bore 18 of the second connector 17 and preferably is press-fitted. Alternatively the metering inset 29 may be merely inserted into the bore 18, in which case however it must be secured against rotation by a suitable system of spring and groove. In that event it may be disassembled for cleaning. In another alternative, the metering inset 29 also may be integral with the second connector 17, ie it may be so manufactured. In the last case the entire second connector 17 must be pressed or soldered into the mixing head 10 in order to assure the proper position of the metering inset 29 relative to the mixing chamber 11.

The metering inset 29 comprises a bore 30 coaxial with the bore 18 of the second connector 17 but in the form of a blind hole. The blind bore 30 issues at its end into two lateral cross-bores 31 and 32 (FIGS. 4 and 5).

In the embodiment mode of FIG. 4 the two cross-bores 31, 32 are in the form of a continuous bore and are orthogonal to the longitudinal axis denoted by 33 and common to the mixing head 10, connecting tube 20 and snout 22. In the embodiment mode of FIG. 5 on the other hand the two cross-bores denoted by 31*a* and 32*a* slope upwards, that is opposite the direction of flow 34 of the gas component fed in at 13, and they are symmetric to the common longitudinal axis 33 of the mixing head 10, connecting tube 20 and snout 22. The two cross bores 31*a* and 32*a* in this case subtend an angle of 45° to the longitudinal axis 33, ie they subtend to each other an angle of 90°.

The liquid flow supplied in the direction of the arrow 35 through the bores 18 and 30 is deflected on both sides at right angles by the cross-bores 31, 32 and 31*a*, 32*a* and is guided inside the mixing chamber 11 against its cylindrical wall. The liquid recoils from the walls of the mixing chamber 11 and is atomized thereby and intensively mixed with the gas component supplied at 13 in the direction of the arrow 34. Thereupon the mixture of gas and liquid so obtained is carried by the kinetic energy of the gas flow in the direction of arrow 34 out of the mixing chamber 11 into the connecting tube 20 and from there to the snout 22 where at last it exits from the nozzle discharge 28 as a fan-shaped flat jet into the surroundings.

The snout 22 is rounded at its end at 36 and comprises a cylindrical bore 38 offset at 37 and merging at its end zone on the side of the nozzle discharge into a spherical round 39.

A baffle is mounted inside the snout bore 38 and is shown in the embodiment of FIG. 1 in the form of a disk 40. The baffle 40 here rests on the offset 37 and is held on the back side by a tubular spacer 41 in turn resting on the end face of the tubular connector 20. A central circular transmission aperture 42 is present in the baffle 40 and evinces sharp edges. The purpose of this inset consisting of baffle 40 and spacer 41 is to deflect the mixed flow by detaching the gas-liquid flow at the sharp edge of the transmission aperture 42 in order that the desired large jet-angle shall be formed at the nozzle discharge 28. The two-piece embodiment of the inset, namely of baffle 40 and spacer 41, shown in FIG. 1 is characterized by making simple manufacture possible. It is important as regards the baffle 40 that the diameter of the transmission aperture 42 be less than that or those of the snout bore 38.

On the other hand the embodiment mode of FIG. 2 shows an integral inset 43, that is, therein the baffle and the spacer form a common, pot-shaped component. The same considerations apply to the baffle transmission aperture also denoted here by 42 and to the inset 43 a in relation to the embodiment of FIG. 1.

The embodiment of FIG. 2 further evinces a feature in that the connecting tube denoted therein by 20*a* and between the mixing head 10 and the snout 22 consists of two pieces. That is, it consists of a tubular part 44 and of an end part 45 attached to it as seen in the direction of flow 34 and welded to the tubular part 44 at 46. The two-piece design of the tubular connector 20*a* of FIG. 2 may be advantageous in manufacture relative to the integral tubular connector 20 of FIG. 1.

Depending on application and particulars of integration, the length of the tubular connector 20 or 20*a* may be varied.

In the embodiment mode shown in FIG. 3, the tubular connector denoted therein by 20*b* is made integral similar to the embodiment shown in FIG. 1 but it is substantially shorter than the tubular connector 20 of FIG. 1. Another particular of the embodiment of FIG. 3 is that the metering inset 29*b* enters more deeply the mixing chamber 11 of the mixing head 10 than is the case for the embodiments of FIGS. 1 and 2. Whereas therein the cross-bores 31, 32 and 31*a*, 32*a* intersect the continuous longitudinal axis 33 of the entire nozzle, in the embodiment of FIG. 3 however the cross-bores 31*b*, 32*b* are not mounted in the nozzle center denoted by the longitudinal axis 33. This is to emphasize that the cross-bores 31*b*, 32*b* may be present at different locations along the axis 47 of the metering inset 29*b*.

By means of the above described steps—namely deep penetration of the metering inset 29 in the mixing chamber 11 on one hand and locating the cross-bores 31*b*, 32*b* at different sites on the axis 47 of the metering inset 29*b* on the other—it is possible to achieve symmetry of distribution of the atomized liquid entering the ambient from the nozzle discharge 28.

FIG. 6 shows another particular which is common to all the above described embodiment modes. It concerns a conical lathed hollow 48 at the end face 49 at the nozzle discharge side of the coupling nut 23. The conical, lathed hollow 48 annularly encloses the nozzle discharge slit 28. As a result some bilateral, radial extension of the arcuate boundary edge denoted by 50 in FIGS. 1-3 of the nozzle discharge slit 28 is achieved. This provides guidance of the flow of gas and liquid issuing at 28, entailing sharp boundaries of the spray fans and hence a desired, constant jet angle.

We claim:

1. A binary, flat-jet nozzle for atomizing liquids with uniform liquid distribution (so-called rectangle characteristic), with a mixing head (10) forming a mixing chamber (11) and comprising a first connector (13) for a gaseous medium and a second connector (17) for the liquid to be atomized, further with a preferably tubular connector (20, 20*a*, 20*b*) connected to the above connectors in the direction of flow (34) and with a snout (22) forming the nozzle discharge (28) and mounted preferably in detachable manner by a coupling nut (23) at the discharge side of the tubular connector, the nozzle-discharge side end (36) of said snout being rounded and in the form of a nozzle discharge evincing a slit (28) of variable width the first connector (13) for the gas supply being coaxial with the longitudinal axis (33) common to the mixing head (10), tubular connector (20, 20, 20*b*) and snout (22) and the second connector (17) for the liquid supply being orthogonal to this longitudinal axis (33), characterized in that a cylindrical metering inset (29, 29*a*, 29*b*) entering the mixing chamber (11) is mounted in the second connector (17) for the liquid supply and comprises a cylindrical blind bore (30) which issues approximately at the center of the mixing chamber (11) on each side into a cross-bore (31, 32; 31*a*, 32*a*) subtending an angle ($\alpha$) relative to the longitudinal axis (33), and in that the snout (22) comprises an offset cylindrical bore (38) with an arched bottom (39) and in that a baffle (40, 43) with a sharp-edged, central transmission aperture (42) is seated on the bore offset (37), the inside diameter of said transmission aperture being less than the diameter of the offset snout bore (38).

2. Binary, flat-jet nozzle defined in claim 1, characterized in that the bilateral cross-bores (31, 32) are in the form of a continuous bore orthogonal or substantially orthogonal to the longitudinal axis (33) common to the mixing head (10), tubular connector (20, 20*a*, 20*b*) and snout (22). FIG. 1.

3. Binary, flat-jet nozzle defined in claim 1, characterized in that in that the two cross-bores (31*a*, 32*a*) are slanting upward, ie opposite the direction of flow (34) of the gas component fed to the first connector (13) and are symmetric to the longitudinal axis (33) common to the mixing head (10), tubular connector (20, 20*a*, 20*b*) and snout (22). FIG. 5.

4. Binary, flat-jet nozzle defined in claim 3, characterized in that the two cross-bores (31*a*, 32*a*) subtend relative to each other an angle ($2\alpha$) of 90° or essentially 90°. FIG. 5.

5. Binary, flat-jet nozzle defined by claim 1, characterized in that the metering inset (29, 29*a*, 29*b*) is a separate part and pressed into the mixing head (10).

6. Binary, flat-jet nozzle defined in claim 1, characterized in that the metering inset (29, 29*a*, 29*b*) forms a common component with the second connector (17) and in that the second connector (17) is pressed or soldered into the mixing head (10).

7. Binary, flat-jet nozzle defined in claim 1, characterized in that the metering inset (29, 29*a*, 29*b*) is a separate piece and is inserted into the second connector (17) screwed into the mixing head (10) and is secured by a system of groove and spring against rotation.

8. Binary, flat-jet nozzle defined in claim 1, characterized in that the baffle is in the form of a disk (40) which on one hand rests on the offset (37) of the snout bore (38) and on the other is held in place by a tubular spacer (41) mounted in the snout bore (38), said tubular spacer resting in the rearward direction on the discharge-side end face of the tubular connector (20). FIG. 1.

9. Binary, flat-jet nozzle defined by claim 1, characterized in that the baffle (43) is pot-shaped and abuts by its bottom comprising the transmission aperture (42) on the offset (37) of the snout bore (38) and rests by its rear (pot) rim on the dischargeside end face of the tubular connector (20*a*, 45; 20*b*). FIGS. 2 and 3.

10. Binary, flat-jet nozzle defined in claim 1, characterized in that the coupling nut (23) fastening the snout (22) to the tubular connector (20, 20*a*, 20*b*) comprises a conical, lathed hollow (48) at its discharge-side end face (49), where said hollow forms a bilateral (radial) extension of the arcuate boundary edge (50) of the nozzle discharge slit (28).

* * * * *